US007426962B2

(12) United States Patent
Moen et al.

(10) Patent No.: US 7,426,962 B2
(45) Date of Patent: Sep. 23, 2008

(54) FLOW CONTROL DEVICE FOR AN INJECTION PIPE STRING

(75) Inventors: Terje Moen, Sandnes (NO); Ole S. Kvernstuen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 205 days.

(21) Appl. No.: 10/525,618

(22) PCT Filed: Aug. 22, 2003

(86) PCT No.: PCT/NO03/00291

§ 371 (c)(1),
(2), (4) Date: Jul. 26, 2005

(87) PCT Pub. No.: WO2004/018837

PCT Pub. Date: Mar. 4, 2004

(65) Prior Publication Data

US 2006/0048942 A1 Mar. 9, 2006

(30) Foreign Application Priority Data

Aug. 26, 2002 (NO) ..... 20024070

(51) Int. Cl.
*E21B 34/06* (2006.01)

(52) U.S. Cl. ..... 166/306; 166/373

(58) Field of Classification Search ..... 166/334.4
See application file for complete search history.

(56) References Cited

U.S. PATENT DOCUMENTS

| | | | | |
|---|---|---|---|---|
| 4,640,355 A | | 2/1987 | Hong | |
| 4,782,896 A | | 11/1988 | Witten | |
| 4,921,044 A | | 5/1990 | Cooksey | |
| 5,435,393 A | | 7/1995 | Brekke et al. | |
| 5,706,891 A | | 1/1998 | Schraub | |
| 6,059,032 A | * | 5/2000 | Jones | 166/278 |
| 6,112,815 A | | 9/2000 | Boe et al. | |
| 6,247,536 B1 | * | 6/2001 | Leismer et al. | 166/305.1 |
| 6,343,651 B1 | * | 2/2002 | Bixenman | 166/278 |
| 6,772,837 B2 | * | 8/2004 | Dusterhoft et al. | 166/278 |

FOREIGN PATENT DOCUMENTS

| | | |
|---|---|---|
| EP | 0 588 421 | 3/1994 |
| WO | WO-01/65063 | 9/2001 |
| WO | WO-02/075110 | 9/2002 |

* cited by examiner

*Primary Examiner*—Jennifer H Gay
(74) *Attorney, Agent, or Firm*—Jeremy P. Welch; Bryan P. Galloway

(57) ABSTRACT

An injection pipe string (4) in a well (2) for the injection of a fluid into at least one reservoir (6) intersected by the string (4), in which at least parts of the injection string (4) opposite the at least one reservoir (6) are provided with one or more outflow positions/-zones. At least one pressure-loss-promoting flow control device is provided to each outflow position/-zone. In position of use, the flow control device(s) control(s) the outflow rate of the injection fluid to a reservoir rock opposite said position/zone. The flow control device(s) is (are) disposed between an internal flow space (18) of the injection string (4) and the reservoir rock opposite said position/zone, and said device(s) is (are) hydraulically connected to at least one through-going pipe wall opening (28, 86) in the injection string (4), and to said reservoir rock. By using such flow control devices, the outflow profile of the injection fluid may be appropriately controlled along the injection string (4).

32 Claims, 7 Drawing Sheets

FLOW CONTROL DEVICE FOR AN INJECTION PIPE STRING

CROSS REFERENCE TO RELATED APPLICATION

Figure 1:
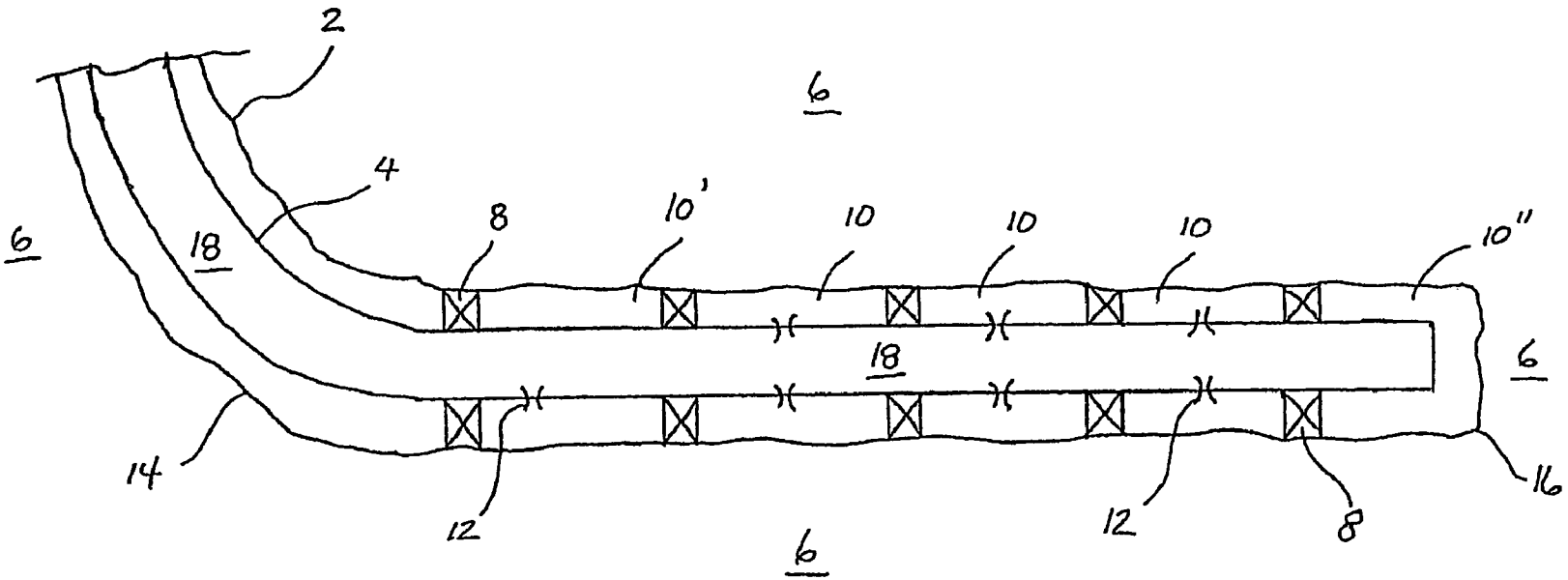

The present application is the U.S. national stage application of International Application PCT/NO2003/000291, filed Aug. 22, 2003, which international application was published on Mar. 4, 2002 as International Publication WO 2004/018837. The International Application claims priority of Norwegian Patent Application 20024070, filed Aug. 26, 2002.

FIELD OF INVENTION

The present invention relates to a flow control device for controlling the outflow rate of an injection fluid from an injection pipe string of a well in connection with stimulated recovery, preferably petroleum recovery. The fluid is injected from surface through well pipes extending i.a. through permeable rocks of one or more underground reservoirs, hereinafter referred to as one reservoir. Hereinafter, the pipe string through the reservoir is referred to as an injection string. The injection fluid may consist of liquid and/or gas. In stimulated petroleum recovery, it is most common to inject water.

The invention is particularly useful in a horizontal, or approximately horizontal, injection well, and particularly when the injection string is of long horizontal extent within the reservoir. Hereinafter, such a well is referred to as a horizontal well. However, the invention may just as well be used in non-horizontal wells, such as vertical wells and deviated wells.

BACKGROUND OF THE INVENTION

The background of the invention is related to injection-technical problems associated with fluid injection, preferably water injection, into a reservoir via a well. Such injection-technical problems are particularly prevalent when injecting from a horizontal well. These problems often result in downstream reservoir-technical and/or production-technical problems.

During fluid injection, the injection fluid flows out radially through openings or perforations in the injection string. Depending on the nature of the reservoir rock in question, the injection string is either fixed through cementation or disposed loosely in a borehole through the reservoir. The injection string may also be provided with filters, or so-called sand screens, preventing formation particles from flowing back into the injection string during a temporary break in the injection.

When the injection fluid is flowing through the injection string, the fluid is subjected to flow friction, which results in a frictional pressure loss, particularly when flowing through a horizontal section of an injection string. This pressure loss normally exhibits a non-linear and greatly increasing pressure loss progression along the injection string. Thus the outflow rate of the injection fluid to the reservoir will also be non-linear and greatly decreasing in the downstream direction of the injection string. At any position along a horizontal injection string, for example, the driving pressure difference (differential pressure) between the fluid pressure within the injection string and the fluid pressure within the reservoir rock therefore will exhibit a non-linear and greatly decreasing pressure progression. Thereby, the radial outflow rate of the injection fluid per unit of horizontal length will be substantially greater at the upstream "heel" of the horizontal section than that of the downstream "toe" of the well, and the fluid injection rate along the injection string thereby becomes irregular and decreasing. This causes substantially larger amounts of fluid being pumped into the reservoir at the "heel" of the well than that of its "toe". Thereby, the injection fluid will flow out of the horizontal section of the well and spread out within the reservoir as an irregular, non-uniform (inhomogeneous) and partly unpredictable flood front, inasmuch as the flood front drives reservoir fluids towards one or more production wells. Normally, such an irregular, non-uniform and partially unpredictable flood front is unfavourable with respect to achieving optimal recovery of the fluids of the reservoir.

An uneven injection rate may also occur as a result of inhomogeneity within the reservoir. The part of the reservoir having the highest permeability will receive most fluid. This creates an irregular flood front, and the fluid injection thus becomes non-optimal with respect to downstream recovery from production wells.

To prevent or reduce such an irregular injection rate profile along the injection string, it is desirable to pump the injection fluid into the reservoir at a predictable radial outflow rate per unit of length of a horizontal injection string, for example. Normally, it is desirable to pump the injection fluid at equal or approximately equal radial outflow rate per unit of length of the injection string. Thereby, a uniform and relatively straight-line flood front is achieved, moving through the reservoir and pushing the reservoir fluid in front of it. This may be achieved by appropriately adjusting, and thereby controlling, the energy loss (pressure loss) of the injection fluid as it flows radially out from the injection string and into the reservoir. The energy loss is adjusted relative to the ambient pressure conditions of the string and of the reservoir, and also to the reservoir-technical properties at the outflow position/zone in question.

In connection with a horizontal well, it may also be desirable to create a flood front having a geometric shape that, for example, is curvilinear, arched or askew. Thereby, it is possible for a reservoir to better adjust, control or shape the flood front relative to the specific reservoir conditions and properties, and relative to other well locations. Such adaptations, however, are difficult to carry out by means of known injection methods and equipment.

An irregular, non-uniform and partly unpredictable flood front may also emanate from a non-horizontal well. The above-mentioned fluid injection problems therefore are relevant to non-horizontal wells, too.

Principally, this invention seeks to remove or limit this unpredictability and lack of control of the injection flow, this resulting in a better shape and movement of the fluid front within the reservoir.

PRIOR ART AND ITS DISADVANTAGES

Depending on the nature of the reservoir rock in question, the injection string is either fixed through cementation or disposed loosely in a borehole through the reservoir.

According to the prior art, and in order to control the injection rate profile along the injection string, so-called selective perforation may be carried out in the injection string. This method is normally employed when the injection string is fixed through cementation in the borehole. In this connection, explosive charges are lowered into the well, after which they are detonated inside the string and blast holes in it. At a desired perforation density, the charges are detonated in the relevant zone(s) of the string. A substantial disadvantage of this detonation method is that it is not possible, even in a successful perforation operation, to control the geometric shape and flow section of the individual perforation. Moreover, uncertainty often prevails as to how many charges have detonated in the well and/or whether the charges have detonated in the correct locations. Furthermore, uncertainty exists as to whether the perforations provide sufficient quality as outflow openings. Hence, predictable and precise control of the injection fluid energy loss, and thus its outflow rate, is not possible between the injection string and the reservoir. The perforation operation may also cause formation-damage effects affecting the subsequent fluid injection into the reservoir. Formation particles, for example, may dislodge from the borehole wall of the well and then flow into the injection string during a potential break in the fluid injection. This is additional to the formation-damage effects often occurring, and is caused by the injection pressure of the fluid. The perforation operation may also compress soft rocks to a degree greatly reducing the flow properties of the rock. Moreover, a certain safety risk will always be related to transport, use and storage of such explosive charges.

When using a non-cemented injection string in the wellbore, it is common in the art to provide the string with a prefabricated, and thereby predetermined, number of holes that are placed at suitable positions along the string. To ensure sufficient fluid outflow from said positions along the string, it is common to provide the string with an excess of holes. It is also normal to provide a non-cemented injection string with external packer elements that prevent fluid flow along the annulus between the string and the surrounding rock. To prevent backflow of formation particles during injection breaks, it is also common to provide the string with sand screens located between the reservoir and the holes in the string. As the hole configuration in the string is prefabricated and thereby predetermined, this method has little flexibility with respect to making subsequent changes to said hole configuration. This provides little possibility for making such changes to the hole configuration immediately prior to inserting the string into the well. The fact that Normally provided the string with an excess of holes also reduces the possibility of gaining optimal control of injection rates along the string.

OBJECT OF THE INVENTION

The object of the invention is to provide an injection pipe string that, during fluid injection into a reservoir, is arranged to provide a better and more predictable control of the injection flow along the string. This causes a better and more predictable shape and movement of the resulting flood front in the reservoir, whereby an optimal stimulated reservoir recovery may be achieved.

Another objective of the invention is to provide an injection string being provided with a flexibility of use that allows the length of the string to be adapted with an optimal pressure choking profile immediately prior to being lowered into the well and being installed in the reservoir.

Achieving the Object

The object is achieved by providing at least parts of the injection string being located opposite one or more reservoirs, with at least one pressure-loss-promoting flow control device of the types presented herein. The at least one flow control device is used to control the outflow rate of the injection fluid to the at least one reservoir. Said device is placed between the internal flow space of the injection string and the reservoir rock opposite the injection string. With the exception of sealing plugs or similar devices, each flow control device is hydraulically connected to both the at least one through-going wall opening of the injection pipe string, and to said reservoir rock. The at least one through-going wall opening of the pipe string may consist, for example, of a bore or a slot opening. The at least one flow control device is placed in one or more outflow position(s)/-zone(s) along the relevant part of the injection string.

When using the present invention, the injection string may be placed either in a cemented and perforated well, or it may be completed in an open wellbore. In the first case, the injection string is placed in a completion string existing already. Thereby, fluid communication between the injection string and the reservoir rock does not have to occur directly against an open wellbore.

When used in an open wellbore, an annulus initially will exist between the injection string and the borehole wall of the well. As mentioned, unfavourable cross- or transverse flows of the injection fluid may occur in this annulus during injection. In some cases, it may therefore be necessary to place zone-isolating sealing elements within the annulus, thus preventing such flows. This may also be necessary when placing the injection string in an existing completion string.

In the open borehole, if no great fluid pressure differences are planned along the injection string, it is not always necessary to use such sealing elements in the annulus. In some cases, however, the reservoir rock may collapse about the string, thereby creating a natural flow restriction in the annulus. Hydraulic communication along the injection string may also be prevented by carrying out so-called gravel-packing in this annulus. In yet other cases, for example in a horizontal injection well, the reservoir rock is sufficiently permeable for the injection fluid to flow easily into the rock at the different outflow rates used along the injection string, thereby preventing problematic flows from occurring in said annulus. In such cases, it is unnecessary to use sealing elements in the annulus.

When flow-through flow control devices of the present types are used, the injection fluid is forced to flow through the at least one flow control device and into the reservoir rock. By using at least one flow control device according to the invention, the injection string thus may be arranged to produce a predictable and adapted energy loss/pressure loss, hence a predictable and adapted outflow rate, in the respective fluid outflows therefrom.

The present flow control devices may be arranged in accordance with two different rheological principles of inflicting an energy loss in a flowing fluid.

One principle is based on energy loss in the form of flow friction occurring in flows through pipes or channels, in which the pressure loss substantially is proportional to the geometric shape, i.e. length and flow section, of the pipe/channel. Through suitable adjustment of the length and/or flow section of the pipe/channel, the flow friction (pressure loss) and fluid flow rate therethrough may be controlled.

The second principle is based on energy loss in the form of an impact loss resulting from fluids of different velocities colliding. This energy loss assumes fluid flow through a flow restriction in the form of a nozzle or an orifice. The orifice is in the form of a slot or a hole. A nozzle or an orifice is a velocity-increasing element formed with the aim of rapidly converting the pressure energy of the fluid into velocity energy without inflicting a substantial energy loss in the fluid during its through-put. Consequently, the fluid exits at great velocity and collides with relatively slow-flowing fluids at the downstream side of the nozzle or orifice. Preferably, collision of fluids is effected within a collision chamber at the downstream side of the nozzle or orifice, the collision chamber being formed, for example, between the injection string and a surrounding sleeve or housing. To prevent/reduce flow erosion of the sleeve/housing, but also to smooth out the downstream flow profile of the fluid, the collision chamber preferably is provided with a grid plate or a perforated plate made of erosion-resistant material. For example, the plate may be formed of tungsten carbide or a ceramic material. Such continuous energy losses in the form of fluid impact losses reduce the pressure energy of the fluid flowing through, hence reduces the fluid flow rate therethrough. Thus, the fluid flow rate therethrough may be controlled.

Thereby, and according to the invention, a specific outflow position/-zone of the injection string may be provided with a flow control device in the form of at least one pipe or channel, cf. said first flow principle. Either the pipe or channel may exist as a separate unit on the outside of the injection string, or it may be integrated in a collar, sleeve or housing enclosing the injection string. Preferably, the collar, sleeve or housing is removable, pivotal or possibly adjustable.

Moreover, and according to the invention, an outflow position/-zone of the injection string may, in addition to or instead of, be provided with at least one nozzle or at least one orifice, possibly a mixture of nozzles and orifices, cf. said second flow principle. The outflow position/-zone may also be provided with nozzles and/or orifices of different internal diameters. In addition, or instead of, the outflow position/-zone may also be provided with one or more sealing plugs.

According to the invention, the nozzle, orifice or sealing plug is provided in a removable, and therefore replaceable, insert. The insert is placed in an adapted opening associated with the injection string, said opening hereinafter being referred to as an insert opening. Each insert is placed in an adapted insert opening, for example a bore or a punch hole. The insert opening may be formed in the injection string. Alternatively, the insert opening may be formed in a collar located between the injection string and said surrounding housing, the collar being placed in a pressure-sealing manner against both the string and the housing. Each insert may be removably attached in its insert opening by means of a thread connection, a locking ring, for example a snap ring, a clamping plate, a locking sleeve or locking screws.

Furthermore, inserts should be manufactured having identical external size fitting into insert openings of identical internal size. Thereby, an insert provided with one type of flow restriction may be easily replaced with an insert provided with another type of flow restriction. Consequently, each outflow position/-zone along the injection string may easily and quickly be provided with a suitable configuration of inserts producing the desired energy loss in the injection fluid when flowing out to the reservoir.

Also, such inserts may possibly be used in combination with said separate and/or integrated flow pipes/channels in one or more outflow positions/-zones of the injection string. Thus, each individual outflow position/-zone may be provided with one or more flow control devices of the types mentioned, which devices work in accordance with one or both rheological principle(s), and which devices may consist of any suitable combination thereof, including types, numbers and/or dimensions of flow control devices. If appropriate, parts of the injection string may also be arranged without any flow control devices of the present types, or parts of the string may be arranged in a known injection-technical manner, or parts of the string may not be perforated.

To protect against damage, the at least one flow control device is preferably disposed in a housing enclosing the injection string at the outside thereof. Thereby, the housing forms an internal flow channel, one end thereof being connected in a manner allowing through-put to the interior of the injection string via at least one opening in the string, the other and opposite end thereof being connected in a manner allowing through-put to the reservoir, preferably through a sand screen. The housing, or a cover provided thereto, may also be removably arranged relative to the injection string, which provides easy access to the flow control device(s). To prevent a possible influx of formation particles at an injection break, the injection string may also be provided with a sand screen. In position of use, the sand screen is placed between the reservoir rock and the at least one flow control device, possibly between the reservoir rock and said other end of the surrounding housing. Along its outside, the injection string preferably is installed with external packer elements preventing fluid flow along the annulus between the string and the reservoir. However, such packer elements are not essential for the present flow control devices to be used in an injection string.

By means of the present invention, each outflow position/-zone of the injection string thereby may be provided with a suitable configuration of such replaceable and/or adjustable flow control devices causing an adapted and predictable energy loss in the injection fluid when flowing out therefrom. The total energy loss at the individual outflow position/-zone is the sum of the energy loss caused by each individual flow control device associated with that position/zone. Thereby, an adapted and predictable injection rate from the individual outflow position/-zone may be achieved, thereby collectively achieving a desired outflow profile along the injection string.

By means of the present invention, each outflow position/-zone also may be provided with an adapted configuration of flow control devices immediately prior to lowering and installing the string in the well. Thus, the adaptation may be carried out at a well location. This is a great advantage, inasmuch as further reservoir- and well information often is acquired immediately prior to completing or re-completing an injection well. On the basis of this and other information, an optimal pressure choking profile for the injection fluid along the injection string may be calculated immediately prior to installing the string in the well. The present invention makes it possible to arrange the string in accordance with such an optimal pressure choking profile, which is not possible according to the prior art.

Different flow control devices in accordance with the invention will be shown in further detail in the following exemplary embodiments.

DESCRIPTION OF EXEMPLARY EMBODIMENTS OF THE INVENTION

FIG. 1 shows a schematic view of a horizontal injection well 2 with its injection pipe string 4 extending through a reservoir 6 in connection with water injection into the reservoir 6. In this exemplary embodiment, and by means of external packer elements 8, the string 4 is divided into five longitudinal sections 10, thereby being pressure-sealingly separated from each other. Most longitudinal sections 10 are provided with pressure-loss-promoting flow control devices according to the invention, these consisting of, in this example, inserts 12 provided with internal nozzles. In the figure, the most upstream-located longitudinal section 10', at the heel 14 of the well 2, is provided with fewer nozzle inserts 12 than that of the downstream sections 10, whereby the injection water from section 10' is pressure choked to a greater degree than downstream sections thereof. However, the most downstream section 10", at the toe 16 of the well 2, is not provided with any flow control devices according to the invention, section 10" being provided with ordinary perforations (not shown) and also being open at its downstream end.

Via an internal flow space 18 of the injection string 4, the injection water is pumped down from surface and out into the individual longitudinal section 10 opposite the reservoir 6.

Figure 2:
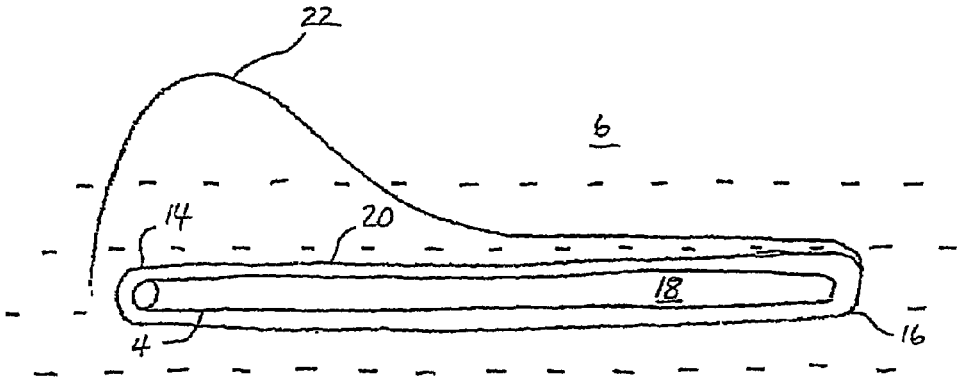

FIG. 2 shows a schematic plan view of a horizontal water injection well 20 being completed in the reservoir 6 by means of conventional cementation and perforation (not shown). The figure shows a schematic water flood profile associated with this type of conventional well completion. In the figure, the resulting water flood profile is indicated by an irregularly shaped water flood front 22 within the reservoir 6. This example shows that the water outflow at the heel 14 of the well 20 is substantially greater than that at its toe 16. Such a water flood profile normally produces undesirable and non-optimal water-flooding of the reservoir 6. Such a profile may also result from inhomogeneity (heterogeneity) in the rocks of the reservoir 6.

Figure 3:
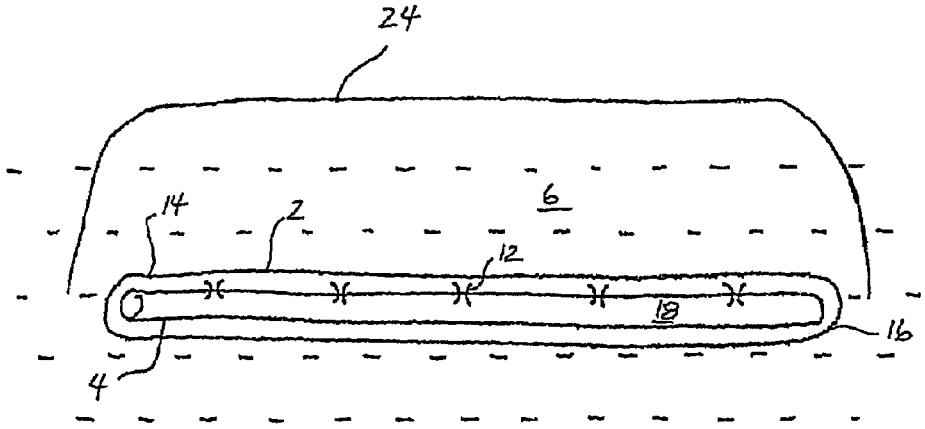

In contrast, FIG. 3 shows a schematic plan view of the horizontal water injection well 2 of FIG. 1 provided with an uncemented injection string 4 having flow control devices according to the invention. Here, the injection string 4 is suitably arranged with nozzle inserts 12 that provide optimal pressure-choking of the injection water flowing out at the pertinent outflow positions along the string 4. In the figure, the resulting water flood profile is indicated by a water flood front 24 of a regular shape within the reservoir 6. Here, the water flood profile is optimally shaped to drive the reservoir fluids out of the reservoir 6 for increased recovery.

Figure 4:
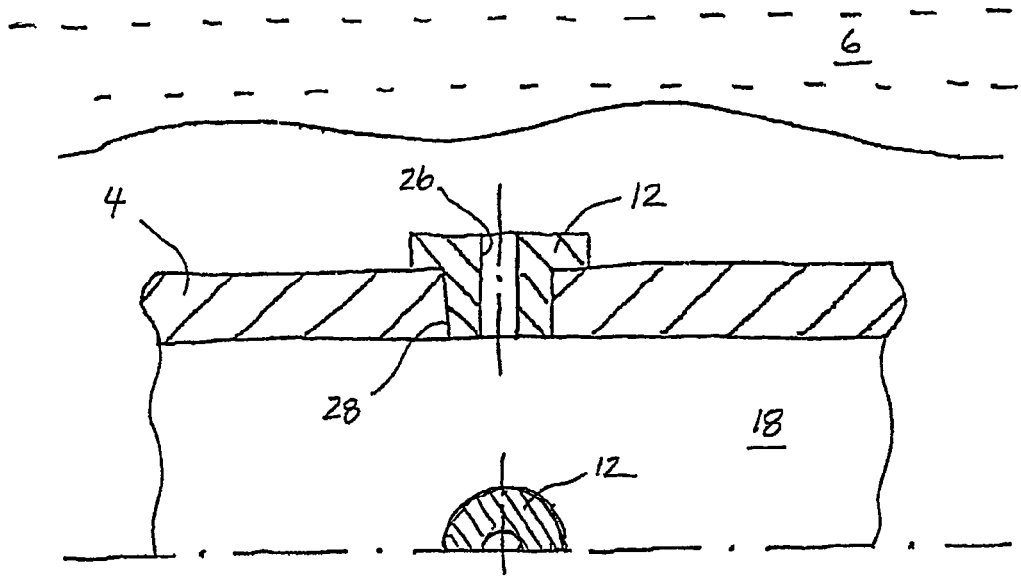

FIG. 4 shows a schematic, half longitudinal section through an injection string 4 placed in the reservoir 6, injection string 4 being provided with removable nozzle inserts 12 according to the invention. The nozzle inserts 12 are provided with internal through-going openings 26, and the inserts 12 are disposed radially within bores 28 in the pipe wall of the injection string 4. The bores 28 are provided with internal threads matching external threads on the inserts 12 (threads not shown in the figure).

Figure 5:
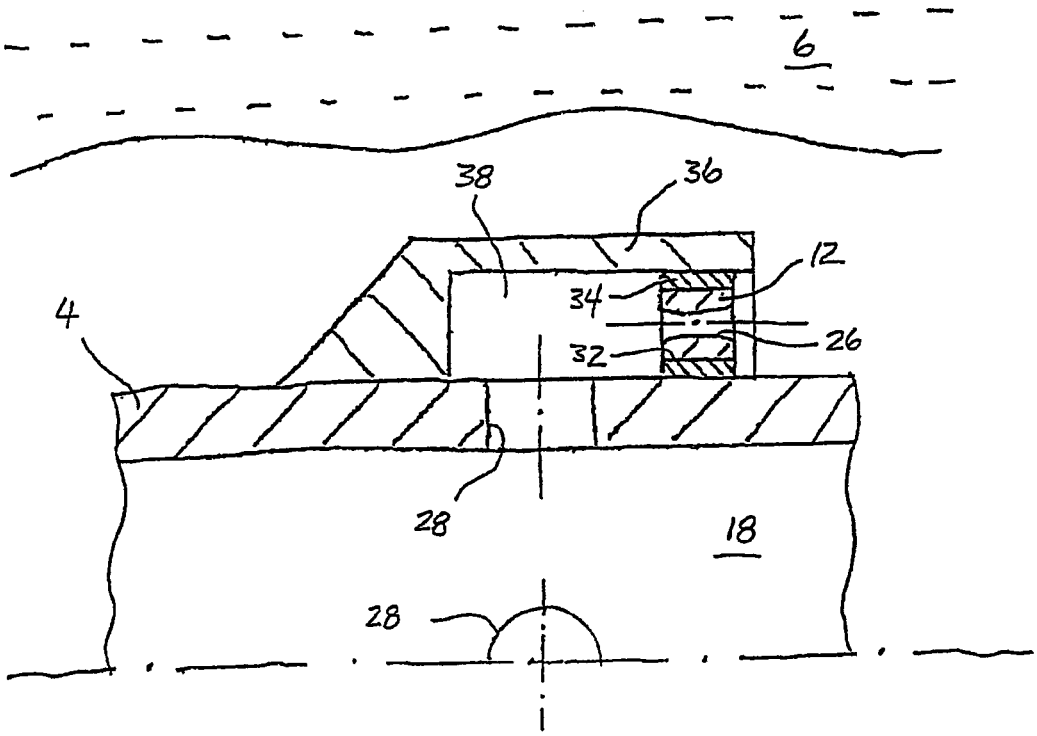

FIG. 5 shows a corresponding schematic longitudinal section through an injection string 4 in the reservoir 6. In this figure also, the injection string 4 is provided with removable nozzle inserts 12 according to the invention, but here the inserts 12 are placed in axial and through-going bores 32 in an annular collar 34 projecting from and around the string 4. The collar 34 is disposed pressure-sealingly against a removable, external housing 36, which pressure-sealingly encloses through-going pipe wall openings in the string 4, and which is open at its downstream end. In this exemplary embodiment, the pipe wall openings consist of radial bores 28, but they may also consist of through-going slots in the string 4. Said axial bores 32 in the collar 34 are provided with internal threads matching external threads of the inserts 12 (threads not shown in the figure). A through-going annular flow channel 38 exists between the collar 34 and the pipe wall openings 28. The flow section of the flow channel 38 is much larger than the flow section of the nozzles, thereby causing the injection water to flow slowly at the upstream side of the collar 34 during the injection, wherein the inherent energy of the water consists of pressure energy. When the water then flows through the nozzle openings 26, this pressure energy is converted into velocity energy. Hence, the water exits the nozzle openings 26 at a high velocity and collides with slow-flowing water at the downstream side of the collar 34. A liquid impact loss giving rise to a liquid pressure loss thus is inflicted on the water, cf. said second flow principle of fluid energy loss. The collar 34 may be adapted with nozzle inserts 12 with nozzle openings 26 of a suitable internal size. For example, the collar 34 may be provided with a suitable number of nozzle inserts 12 having different internal opening diameters, or possibly that some inserts 12 consist of sealing plugs and/or orifices (not shown in the figure). Immediately prior to inserting the string 4 into the well 2 and installing it in the reservoir 6, each collar 34 along the string 4 thus may be arranged to cause an individually adapted pressure loss, which produces an optimal water outflow rate therefrom.

Figure 6:
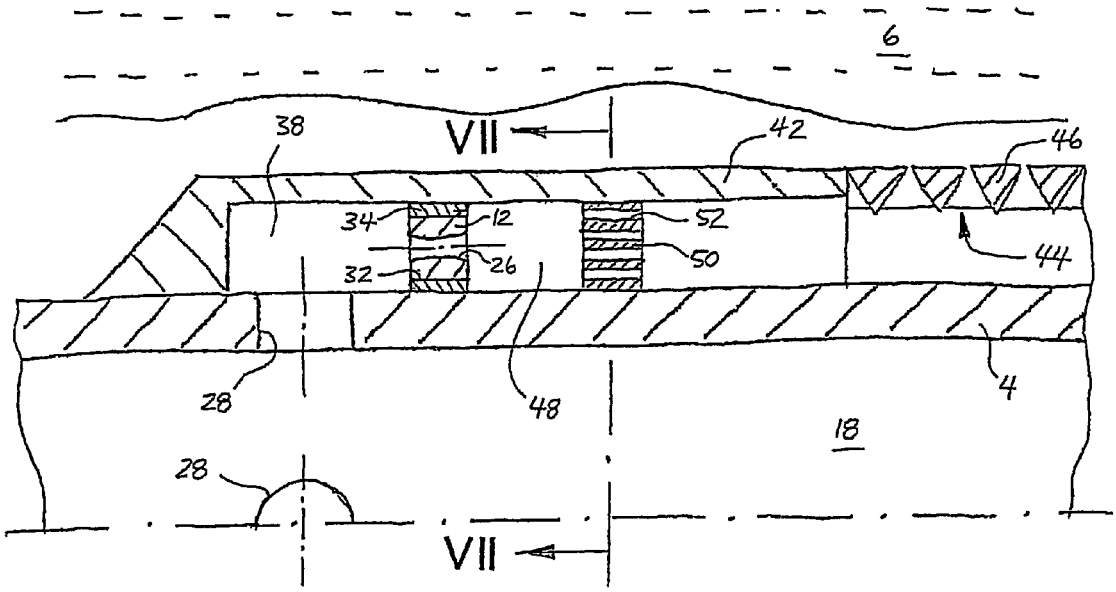

FIG. 6 also shows a schematic longitudinal section through the injection string 4. The figure shows the same nozzle inserts 12 in the collar 34 as those of FIG. 5, in which the collar 34 also here is placed pressure-sealingly against an external, removable housing 42 pressure-sealingly enclosing radial bores 28 in the string 4, and being open at its downstream end. In this exemplary embodiment, however, the housing 42 is connected to a downstream sand screen 44 formed of wire wraps 46 wound around the injection string 4. The invention does not require use of a sand screen 44, but experience goes to show that sand control is appropriate in connection with injection. At its downstream side, the housing 42 is extended axially and past the collar 34, thereby providing an annular liquid collision chamber 48 in this longitudinal interval, in which chamber 48 said liquid impact loss is inflicted. This extension may also be provided by connecting an extension sleeve (not shown) to the housing 42. When water exits the nozzle openings 26 at a high velocity, components located downstream in the injection system may be subjected to erosion. The risk of erosion may be reduced considerably by placing an annular grid plate or a perforated plate in the liquid collision chamber 48 downstream of the nozzle inserts 12. Such a perforated plate 50 provided with several through-going holes 52 is shown in FIG. 6. Flow through several such holes 52 smoothes out the liquid flow profile due to friction against their hole walls.

Figure 7:
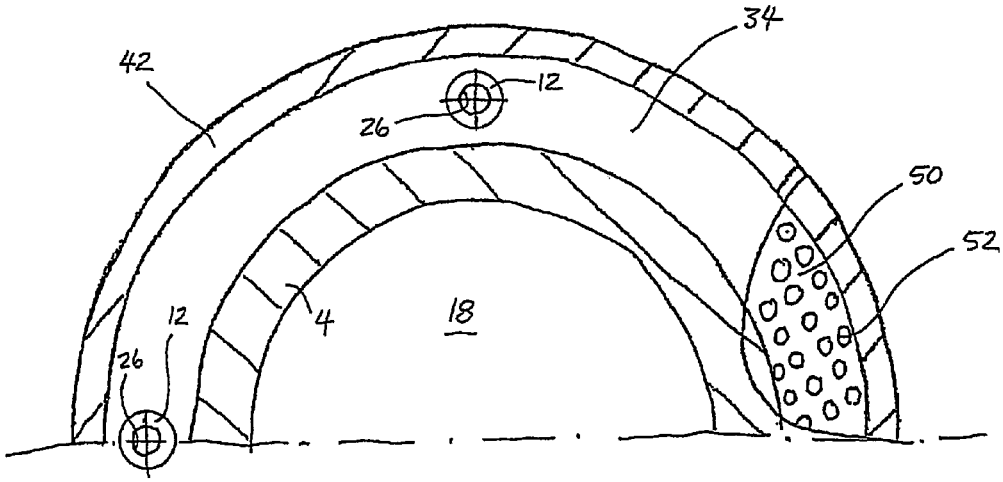

FIG. 7 shows a schematic radial section along the section line IX-IX, cf. FIG. 6, the figure showing only a segment of the perforated plate 50.

Figure 8:
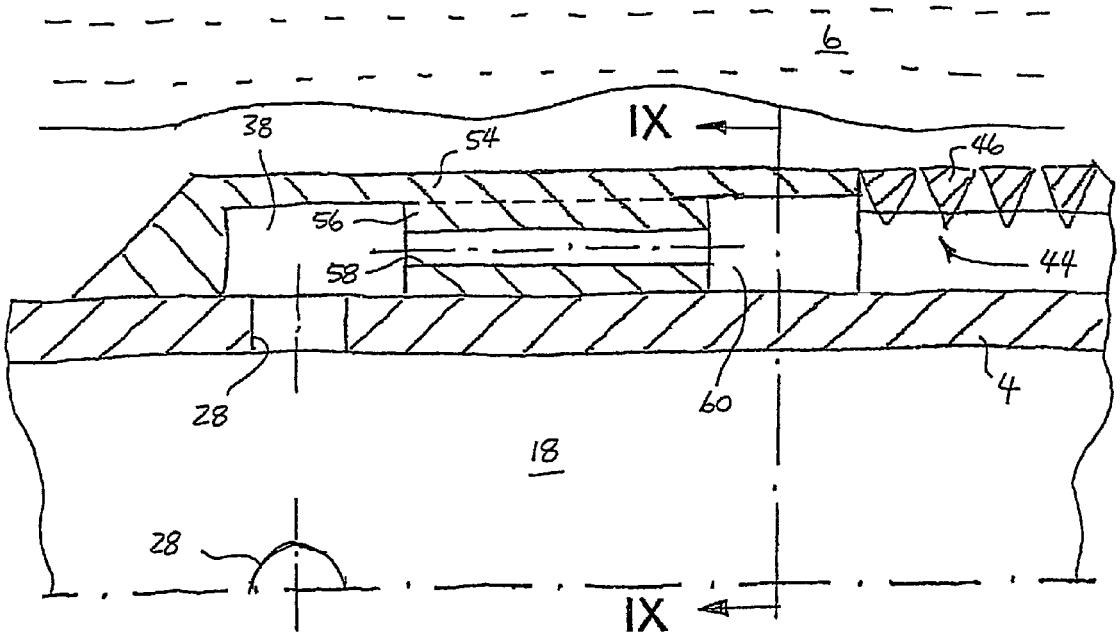

FIG. 8 shows a further schematic embodiment of the invention. Here also, a removable housing 54 is used that pressure-sealingly encloses radial bores 28 in the string 4, and that is open at its downstream end. An annular collar 56 is provided between the housing 54 and the injection string 4. In this exemplary embodiment, the collar 56 is formed as a projecting collar at the inside of the housing 54, the collar 56 surrounding the string 4 in a pressure-sealing manner. However, the collar 56 may just as well be provided as a separate collar disposed in a pressure-sealing manner against both the housing 54 and the string 4. The collar 56 is provided with axial, through-going bores 58. During liquid through-put, the bores 58 act as flow channels causing flow friction, and thereby a pressure loss, in the water injected therethrough. Thus, the collar 56 may be provided with a suitable number of such flow channels/bores 58 of suitable cross-sections and lengths. Moreover, one or more flow channels/bores 58 may be provided with sealing plugs (not shown). In this way, the collar 56 may be provided with flow channels/bores 58 of a desired configuration, thereby causing a desired frictional pressure loss during liquid through-put, immediately prior to inserting the string 4 into the well 2 for installation. In this exemplary embodiment, the downstream side of the bores 58 opens into an annular flow chamber 60 connected to a sand screen 44 located downstream thereof.

Figure 9:
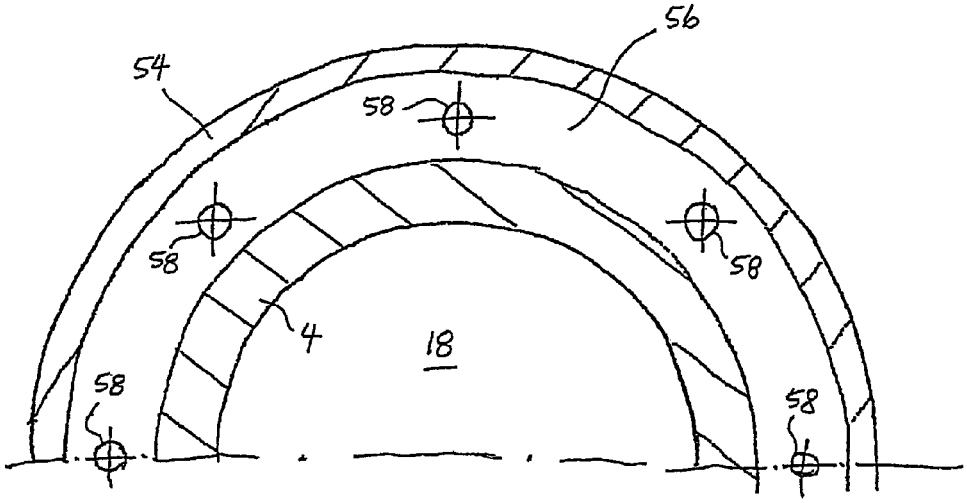

FIG. 9 shows a schematic radial section along section line XI-XI, cf. FIG. 8, the figure showing several axial, through-going bores 58.

Figure 10:
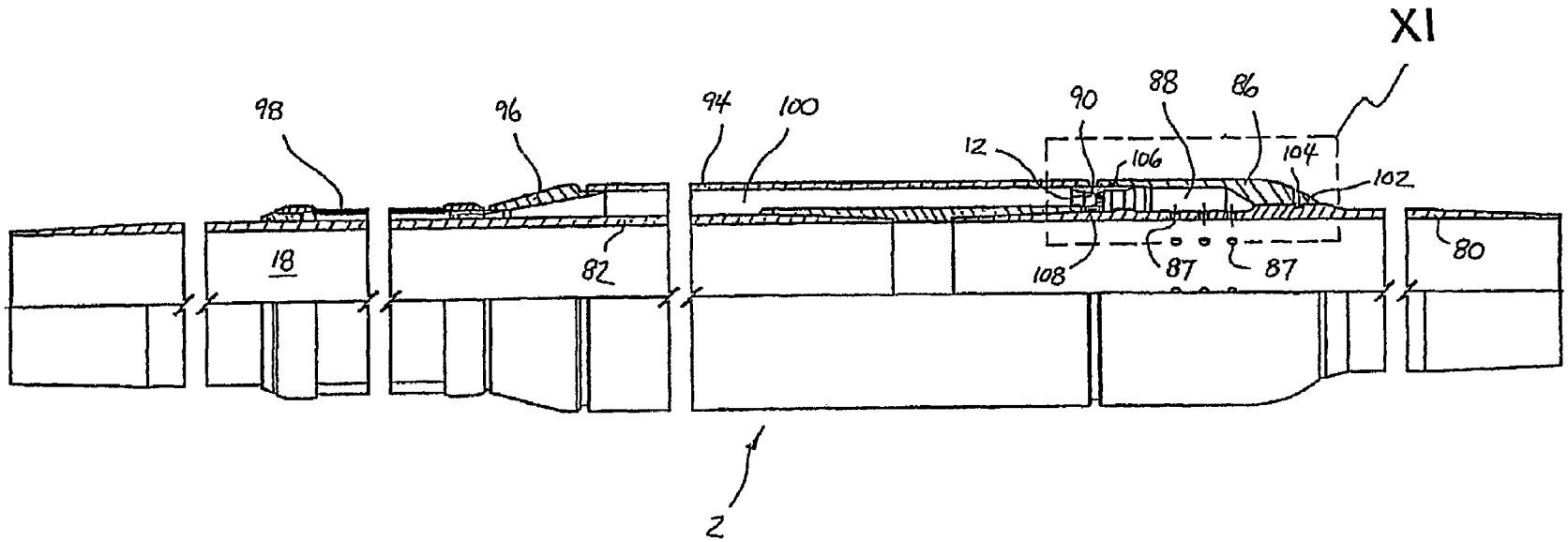

FIG. 10 shows a work embodiment of the present invention. With the exception of said perforated plate 50, this work embodiment is essentially identical to the embodiment according to FIG. 6. In this work embodiment, two base pipes 80, 82 of the injection string 4 are connected via a sub 84. The base pipe 80 is provided with an enclosing, removable housing 86 that pressure-sealingly encloses radial and conically shaped outlet bores 86 in the base pipe 80. The bores 86 lead into an annular flow channel 88 upstream of an annular collar 90 also being pressure-sealingly enclosed by the housing 86. Nozzle inserts 12 are disposed in axial, through-going insert bores 92 in the collar 90. An outer sleeve 94 is connected around the downstream end of the collar 90 and extends downstream thereof and overlaps the base pipe 82 and said sub 84. At its downstream end, the sleeve 94 is connected to a conical connecting sub 96 that connects the sleeve 94 to a sand screen 98, through which the injection fluid may exit. Between the sleeve 94 and the injection string 4 there is an annular liquid collision chamber 100, in which the above-mentioned liquid impact loss is inflicted.

Figure 11:
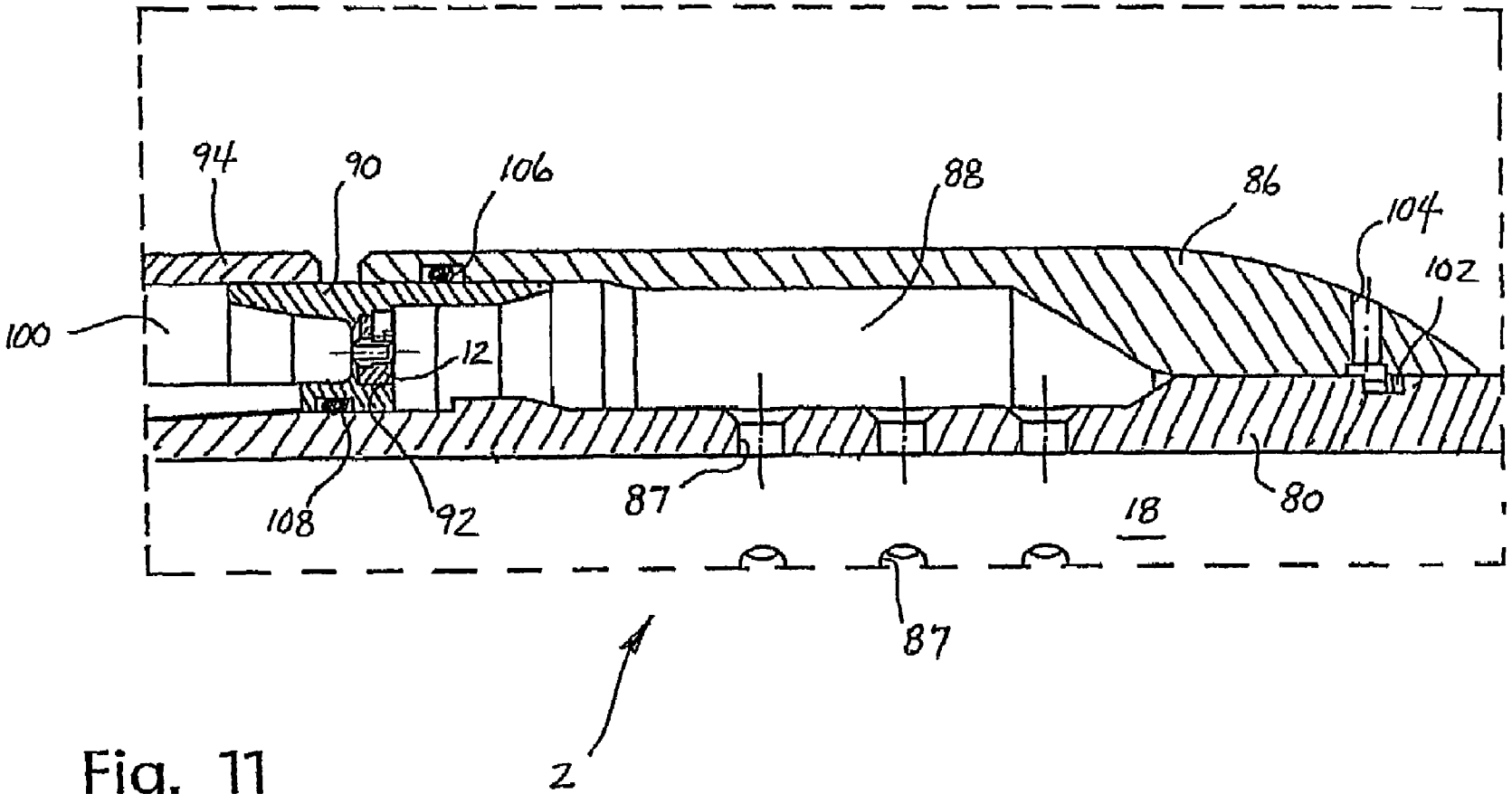

FIG. 11 shows a segment XV of the work embodiment according to FIG. 10. The segment shows structural details on a larger scale, in which a locking ring 102 and an associated access bore 104 of the housing 86 are shown, among other things. The figure also shows a ring gasket 106 between the collar 90 and the housing 86, and also a ring gasket 108 between the collar 90 and the base pipe 80.

The invention claimed is:

1. A well injection string for injection of a fluid into at least one reservoir intersected by the string, in which at least a part of the injection string includes at least one fluid outflow zone provided with one or more through-going pipe wall openings located opposite the reservoir when placed therein, and in which at least one pressure-loss-promoting flow control device in the form of a flow restriction is provided to at least one of said pipe wall openings in the injection string, the flow control device controlling the injection fluid outflow rate therethrough and onwards into the reservoir when placed therein, characterized in that said flow restriction is selected from the following types of flow restrictions:

a nozzle;

an orifice in the form of a slot or a hole; and a sealing plug; and characterized in that said flow restriction is provided as a removable and replaceable insert that nests with the pipewall opening from outside of the injection string.

2. The well injection string according to claim 1, characterized in that the insert is disposed in an insert bore in the pipe wall of the string, the bore comprising said pipe wall opening in the injection string, whereby said outflow zone may be provided with several insert bores, each bore containing a removable insert.

3. The well injection string according to claim 1, characterized in that an outflow zone having two or more inserts arranged thereto, is provided with a mixture of said types of flow restrictions.

4. The well injection string according to claim 1, characterized in that an outflow zone arranged with two or more inserts containing a nozzle or an orifice each, is provided with nozzles or orifices of similar or dissimilar internal opening sizes.

5. The well injection string according to claim 1, characterized in that the inserts in the string are of identical external size and shape.

6. A well injection string for injection of a fluid into at least one reservoir intersected by the string, in which at least a part of the injection string includes at least one fluid outflow zone provided with one or more through-going pipe wall openings located opposite the reservoir when placed therein, and in which at least one pressure-loss-promoting flow control device in the form of a flow restriction is provided to at least one of said pipe wall openings in the injection string, the flow control device controlling the injection fluid outflow rate therethrough and onwards into the reservoir when placed therein, characterized in that said flow restriction is selected from the following types of flow restrictions:

a nozzle;

an orifice in the form of a slot or a hole; and a sealing plug;

characterized in that said flow restriction is provided as a removable and replaceable insert; and characterized in that the insert is disposed in an axially through-going insert bore in an annular collar disposed pressure-sealingly around the injection string so as to project outwardly therefrom; and wherein the collar also is disposed pressure-sealingly against an external and removable housing pressure-sealingly enclosing said at least one pipe wall opening in the injection string, thereby providing a through-going flow channel between the collar and the at least one pipe wall opening, whereby the collar may be provided with several insert bores around the circumference thereof, each bore containing a removable insert.

7. The well injection string according to claim 6, characterized in that the downstream side of said housing is extended axially and past said collar, said extension of the housing thereby forming a through-going and annular fluid collision chamber within which the injection fluid is subjected to a pressure-reducing energy loss.

8. The well injection string according to claim 7, characterized in that a flow-through grid plate or perforated plate of erosion-resistant material is disposed in said fluid collision chamber.

9. The well injection string according to claim 6, characterized in that the downstream side of the housing is connected to a sand screen.

10. A method of controlling an injection fluid outflow rate from at least one fluid outflow zone of a well injection string intersecting at least one reservoir, the at least one fluid outflow zone being provided with one or more through-going pipe wall openings located opposite the reservoir when placed therein, said method being initiated by injecting said fluid from a surface via the injection string and then through at least one pressure-loss-promoting flow control device in the form of a flow restriction provided to at least one of said pipe wall openings in the injection string, after which the injection fluid flows onwards into the surrounding reservoir, characterized in that the method further comprises selecting said flow restriction from the following types of flow restrictions:

a nozzle;

an orifice in the form of a slot or a hole; and a sealing plug; and forming said flow restriction as a removable and replaceable insert that nests with the pipewall opening from outside of the injection string.

11. The method according to claim 10, characterized in that the method further comprises:

disposing the insert in an insert bore in the pipe wall of the string, the bore comprising said pipe wall opening in the injection string, whereby said outflow zone may be provided with several insert bores, each bore containing a removable insert.

12. The method according to claim 10, characterized in that the method further comprises:

providing an outflow zone having two or more inserts arranged thereto, with a mixture of said types of flow restrictions.

13. The method according to claim 10, characterized in that the method further comprises:

providing an outflow zone having two or more inserts arranged thereto, with nozzles or orifices of similar or dissimilar internal opening sizes.

14. The method according to claim 10, characterized in that the method further comprises:

providing the string with inserts of identical external size and shape.

15. A method of controlling an injection fluid outflow rate from at least one fluid outflow zone of a well injection string intersecting at least one reservoir, the at least one fluid outflow zone being provided with one or more through-going pipe wall openings located opposite the reservoir when placed therein, said method being initiated by injecting said fluid from a surface via the injection string and then through at least one pressure-loss-promoting flow control device in the form of a flow restriction provided to at least one of said pipe wall openings in the injection string, after which the injection fluid flows onwards into the surrounding reservoir, characterized in that the method further comprises selecting said flow restriction from the following types of flow restrictions:

a nozzle;

an orifice in the form of a slot or a hole; and a sealing plug;

forming said flow restriction as a removable and replaceable insert; and disposing the insert in an axially through-going insert bore in an annular collar disposed pressure-sealingly around the injection stringy so as to project outwardly therefrom, the collar also being disposed pressure-sealingly against an external and removable housing pressure-sealingly enclosing said at least one pipe wall opening in the injection string, thereby providing a through-going flow channel between the collar and the at least one pipe wall opening, whereby the collar may be provided with several insert bores around the circumference thereof, and a removable insert being disposed in each bore.

16. The method according to claim 15, characterized in that the method further comprises:

extending the downstream side of said housing axially and past said collar, the extension of the housing thereby forming a through-going and annular fluid collision chamber within which the injection fluid is subjected to a pressure-reducing energy loss.

17. The method according to claim 16, characterized in that the method further comprises:

disposing a flow-through grid plate or perforated plate of erosion-resistant material in said fluid collision chamber.

18. The method according to claim 15, characterized in that the method further comprises:

connecting the downstream side of the housing to a sand screen.

19. A well injection string for injection of a fluid into at least one reservoir intersected by the string, in which at least a part of the injection string includes at least one fluid outflow zone provided with one or more through-going pipe wall openings located opposite the reservoir when placed therein, and in which at least one pressure-loss-promoting flow control device is provided to at least one of said pipe wall openings in the injection string, the flow control device controlling the injection fluid outflow rate therethrough and onwards into the reservoir when placed therein, characterized in that the flow control device comprises an annular collar provided with at least one axially through-going bore; wherein the collar is disposed pressure-sealingly around the injection string so as to project outwardly therefrom; and wherein the collar also is disposed pressure-sealingly against an external and removable housing pressure-sealingly enclosing said at least one pipe wall opening in the injection string, thereby providing a through-going flow channel between the collar and the at least one pipe wall opening.

20. The well injection string according to claim 19, characterized in that two or more collars are connected in series when placing two or more flow control devices within one fluid outflow zone along the injection string.

21. The well injection string according to claim 19, characterized in that a collar having two or more axial bores, is provided with bores of similar or dissimilar diameters.

22. The well injection string according to claim 19, characterized in that at least one bore is provided with a sealing plug.

23. The well injection string according to claim 19, characterized in that the collar is removably, pivotally or adjustably disposed around the injection string.

24. The well injection string according to claim 19, characterized in that said housing, or a cover provided thereto, is removably disposed around the injection string.

25. The well injection string according to claim 19, characterized in that the downstream side of the housing is connected to a sand screen.

26. A method of controlling an injection fluid outflow rate from at least one fluid outflow zone of a well injection string intersecting at least one reservoir, the at least one fluid outflow zone being provided with one or more through-going pipe wall openings located opposite the reservoir when placed therein, said method being initiated by injecting said fluid from surface via the injection string and then through at least one pressure-loss-promoting flow control device provided to at least one of said pipe wall openings in the injection string, after which the injection fluid flows onwards into the surrounding reservoir, characterized in that the method further comprises:

using an annular collar provided with at least one axially through-going bore as a flow control device;

disposing the collar pressure-sealingly around the injection string so as to project outwardly therefrom; and disposing the collar pressure-sealingly against an external and removable housing pressure-sealingly enclosing said at least one pipe wall opening in the injection string, thereby providing a through-going flow channel between the collar and the at least one pipe wall opening.

27. The method according to claim 26, characterized in that the method further comprises:

connecting two or more collars in series when placing two or more flow control devices within one fluid outflow zone along the injection string.

28. The method according to claim 26, characterized in that the method further comprises:

providing a collar having two or more axial bores, with bores of similar or dissimilar diameters.

29. The method according to claim 26, characterized in that the method further comprises:

providing at least one bore with a sealing plug.

30. The method according to claim 26, characterized in that the method further comprises:

disposing the collar removably, pivotally or adjustably around the injection string.

31. The method according to claim 26, characterized in that the method further comprises:

removably disposing said housing, or a cover provided thereto, around the injection string.

32. The method according to claim 26, characterized in that the method further comprises:

connecting the downstream side of the housing to a sand screen.

* * * * *